United States Patent [19]

Kurak

[11] Patent Number: 4,733,489

[45] Date of Patent: Mar. 29, 1988

[54] APPARATUS FOR RECONFIGURING AUTOMATIC RIFLE TO INCLUDE GRENADE LAUNCHING FUNCTION

[75] Inventor: Joseph C. Kurak, Fridley, Minn.

[73] Assignee: R/M Equipment, Inc., Miami, Fla.

[21] Appl. No.: 53,096

[22] Filed: May 22, 1987

Related U.S. Application Data

[63] Continuation of Ser. No. 670,477, Nov. 14, 1984.

[51] Int. Cl.[4] ..... F41F 1/00; F41F 5/00

[52] U.S. Cl. ..... 42/77; 42/105

[58] Field of Search ..... 42/105, 77, 85, 86, 42/101, 103

[56] References Cited

U.S. PATENT DOCUMENTS

| | | | |
|---|---|---|---|
| 3,279,114 | 10/1966 | Lewis et al. | 42/105 |
| 3,318,033 | 5/1967 | Barr | 102/483 |
| 3,365,828 | 1/1968 | Badali et al. | 42/39.5 |
| 3,371,578 | 3/1968 | Choate et al. | 42/77 |
| 3,404,478 | 10/1968 | Silsby | 42/105 |
| 3,442,173 | 5/1969 | Muller | 42/105 |
| 3,507,067 | 4/1970 | Into | 42/10 |
| 3,641,691 | 2/1972 | Ellis et al. | 42/105 |
| 3,967,402 | 7/1976 | Cooksey | 42/10 |

*Primary Examiner*—John F. Terapane
*Assistant Examiner*—Eric Jorgensen
*Attorney, Agent, or Firm*—Lawrence M. Nawrocki

[57] ABSTRACT

The present invention is a method and apparatus for reconfiguring an automatic rifle (10) for quick attachment and detachment of a grenade launcher (32). The apparatus invention comprises an upper rack (42) securable to the barrel (16) of the rifle (10), and a lower rack (34) to which the grenade launcher (32) can be secured. The upper and lower racks (42, 34) carry quick connect/disconnect fittings (66, 68, 78, 80) for mating and unmating of the launcher (32) with regard to the rifle (10).

7 Claims, 7 Drawing Figures

APPARATUS FOR RECONFIGURING AUTOMATIC RIFLE TO INCLUDE GRENADE LAUNCHING FUNCTION

This is a continuation of copending application Ser. No. 670,477, filed on Nov. 14, 1984.

TECHNICAL FIELD

The present invention relates broadly to the field of firearms. More narrowly, the invention relates to automatic rifle technologies and to specifics of that field dealing with the reconfiguration of such weapons to enable them to be used as grenade launchers. A preferred embodiment of the invention comprises apparatus for reconfiguring such a weapon for quick attachment and detachment of a grenade launcher. The invention also includes a method for so reconfiguring an automatic rifle.

BACKGROUND OF THE INVENTION

As warfare has progressed through the ages, weapons more and more sophisticated have evolved. While the earliest weapons were extremely rudimentary and capable of killing only a single one of the enemy's soldiers, modern weapon technology has enabled a single combatant to fire a multiplicity of projectiles in a very short period of time. Such weapons have drastically increased the effectiveness of a single soldier, therefore.

The automatic rifle is a weapon that can fire a number of rounds in quick succession. Such operation is accomplished in view of the fact that the functions of firing and reloading are performed by the weapon itself. These functions include firing the cartridge, withdrawing the bolt, ejecting the spent cartridge case, cocking the hammer, forcing the bolt forward, and inserting a fresh cartridge into the chamber ready to fire. The energy for performing these functions is provided in one of two ways: by the pressure of the gas produced by the firing of the cartridges (in gas operated weapons) or by the recoil of the weapon itself.

Another type of weapon which has altered the face of conventional warfare is the grenade launcher. The M79 grenade launcher is a shoulder fired weapon which has been used by the U.S. Army now for some time. While the effectivness of hand-thrown grenades is limited in both distance and accuracy, weapons such as the M79 improve the accuracy with which a grenade can be projected and certainly greatly extend the distance over which grenades can be projected.

The M79 grenade launcher is a dedicated weapon. That is, it is used for one purpose and not in combination with other weapons.

More recently, the M203 grenade launcher has been developed and implemented as a weapon system in the arsenal of the armed forces of the United States. The M203 is the successor of the M79. The desirability of the M203 as compared to the M79 resides in the fact that it fulfills a requirement for a rifle/grenade launcher 25 package, whereas the M79 was only a dedicated grenade launcher.

The M203 is a weapon system that, when operational, is attached to an M16 rifle. Although relatively light in weight, it nevertheless does add some additional weight to the rifle with which it is used. Optimally, the weapon carried by an infantry soldier should be as light as possible at any particular time.

The present invention is both a method and apparatus for allowing selective and rapid configuration and deconfiguration of an automatic rifle as a grenade launcher. As such, it solves problems existent in the prior art and satisfies requirements dictated by the need for light weight weapon systems.

SUMMARY OF THE INVENTION

The present invention is a method of reconfiguring an automatic weapon such as a rifle in order to afford a capability of quick connect and disconnect for a grenade launcher. The method is practiced with respect to a weapon having an elongated barrel and a hand guard encircling at least a portion of the barrel. Upper and lower rack means having fittings capable of mating in order to enable quick and easy attachment and detachment of the lower rack means with respect to the upper rack means are provided. The hand guard typically provided with such an automatic weapon is removed, and the upper rack means is secured to the barrel at an appropriate location with the mating fitting extending accessibly. The hand guard is reworked in order to provide an access port at a location proximate the fitting carried by the upper rack means. The hand guard is, thereafter, remounted to the weapon encircling the weapon barrel and completely enclosing therewithin the upper rack means. The grenade launcher is suspended from the lower rack means with the fitting, carried by that rack means, free so that it can be inserted through the access port provided in the hand guard. A quick connect/disconnect grenade launcher is, thereby, provided.

The preferred manner of practicing the method invention contemplates providing upper and lower rack means, each carrying a pair of mating fittings. It will be understood, however, that the invention encompasses methods utilizing either single or multiple fittings carried by each of the rack means.

The apparatus invention includes upper and lower racks as provided with regard to the method invention. The upper rack includes means for securing that component to the barrel of a rifle, and the lower rack includes means for suspending a grenade launching device therefrom. Quick connect/disconnect means are carried by the upper and lower racks for selectively mating and unmating the racks to and from one another. A hand guard attachable to the rifle in a position encircling at least a portion of the rifle's barrel is provided. The hand guard would encircle the barrel at a location therealong at which the upper rack is mounted to the barrel. The upper rack would be completely enclosed within a boundary circumscribed by a wall of the hand guard. In the preferred embodiment, the hand guard would have a pair of apertures formed therein to afford access for the mating fittings carried by the lower rack to the mating fittings carried by the upper rack.

One embodiment of the invention can provide an axial abutment carried by the upper rack at a location rearwardly of the rearward of the two fittings carried by the upper rack. The abutment can be spaced at a distance from the rearward upper rack fitting so that, when the upper and lower racks are in a mated configuration, a shoulder carried by the lower rack is in engagment with the abutment. Such structuring enables the abutment to absorb the force of recoil generated by the grenade launcher when it is fired. The full effect of that force, therfore, is not brought to bear upon the linkages between the upper and lower rack fittings.

The apparatus invention envisions various structures for accomplishing the mating of the upper and lower racks. One embodiment would provide forward and rearward T-shaped fittings carried by the lower rack and correspondingly located fittings carried by the upper rack, each of the upper rack fittings having formed therein a T-shaped channel to slideably receive its corresponding lower rack fitting It would, in certain embodiments, be desirable to lock the grenade launcher into a fixed axial position relative to the rifle by providing means for locking the upper and lower racks against relative axial movement when they are in a desired mated configuration. One locking means structure incorporates a detent disposed for movement reciprocably generally perpendicular to a surface of a lower rack fitting which is receivable within the T-shaped channel formed in the corresponding upper rack fitting. The corresponding upper rack fitting can be provided with an aperture to receive the detent when the upper and lower racks are properly mated. Preferably, the detent would be biased toward a position at which it would be received within the aperture in the upper rack fitting.

The present invention is, therefore, both a method and apparatus for reconfiguring an automatic rifle so that a grenade launcher can be quickly and easily mated thereto for operation. More specific features and advantages obtained in view of those features will become apparent with reference to the DETAILED DESCRIPTION OF THE INVENTION portion of this document, the appended claims, and the drawing figures.

DETAILED DESCRIPTION OF THE INVENTION

Figure 1:
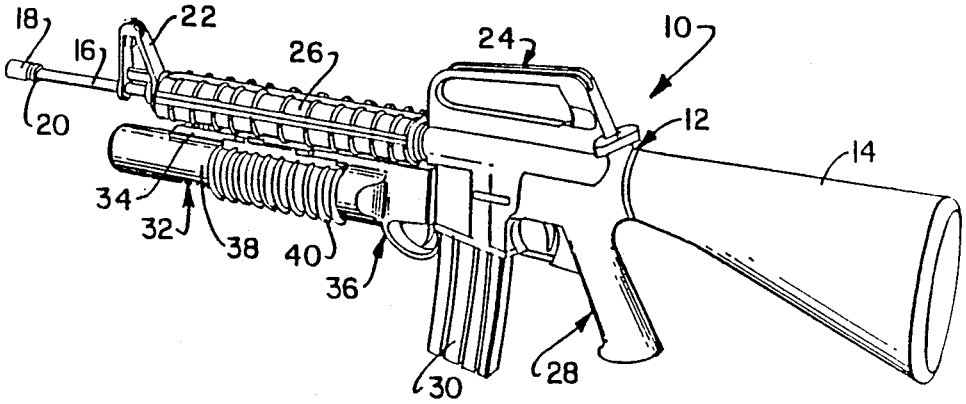
FIG. 1 is a perspective view of an automatic rifle reconfigured in accordance with the present method and apparatus inventions and with a grenade launching device attached thereto.

Referring now to the drawings wherein like reference numerals denote like elements throughout the several views, FIG. 1 illustrates an automatic rifle 10 upon which the present method invention can be practiced by incorporating the apparatus invention therewith. The rifle 10 includes a central breech portion 12, a butt 14 extending rearwardly from the breech portion 12, a barrel 16, having a flash arrester 18 at the forward end 20 thereof, extending forwardly from the breech portion 12, a forward sight 22, a transport handle 24 which includes a rear sight (not shown), a hand guard 26 intermediate the forward sight 22 and the transport handle 24, a grip and trigger assembly 28, and a magazine 30. The rifle 10 is shown as having a grenade launcher 32 mated to the weapon beneath the hand guard 26 by use of apparatus in accordance with the present invention. The grenade launcher 32 is shown as suspended from a lower rack 34, and it includes a trigger mechanism portion 36, a barrel 38, and its own hand guard 40 encircling a portion of the barrel 38.

Figure 2:
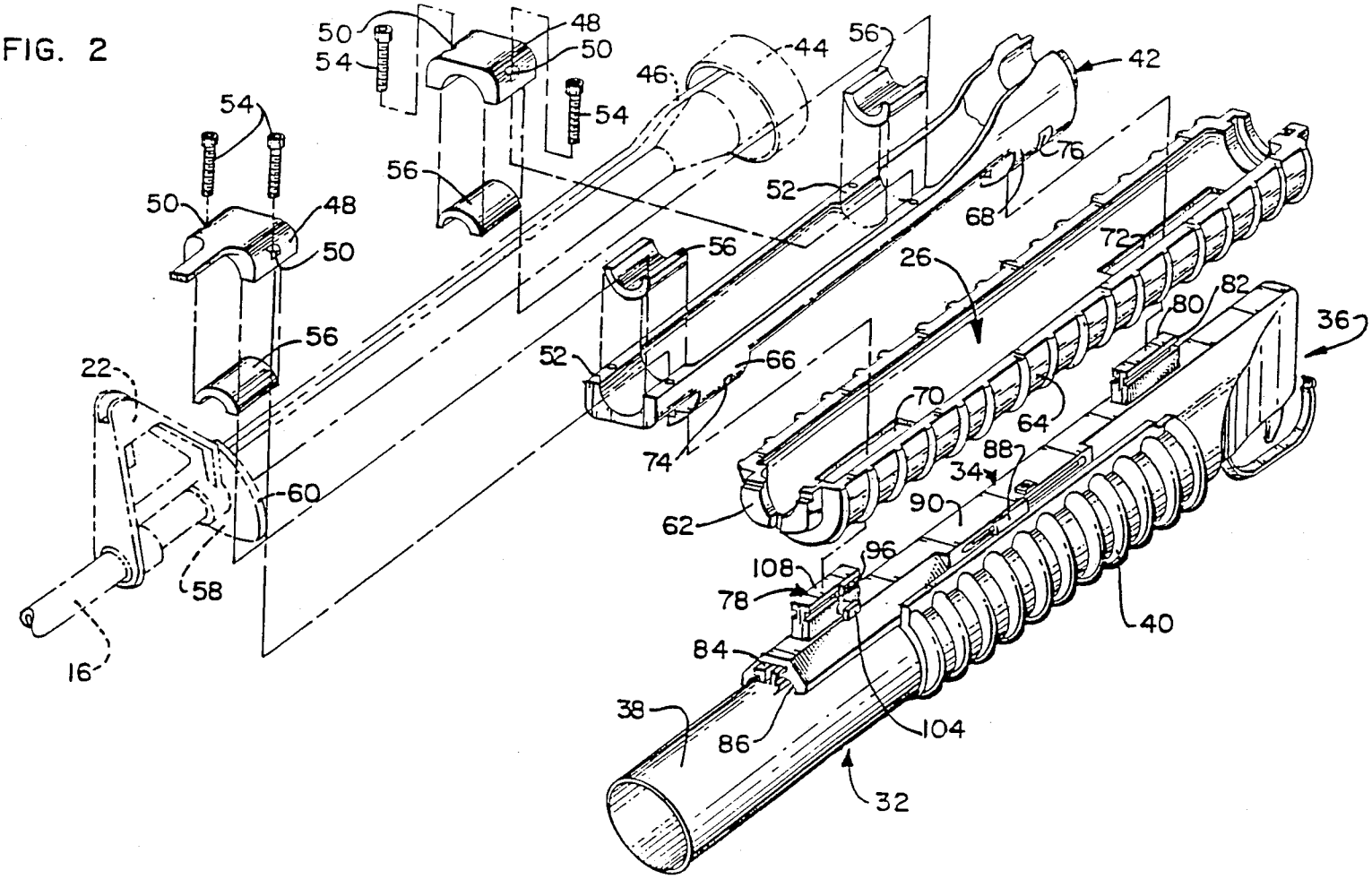
FIG. 2 is an exploded perspective view illustrating in detail the various component parts of the present apparatus invention and the manner in which they are assembled.
Figure 3:
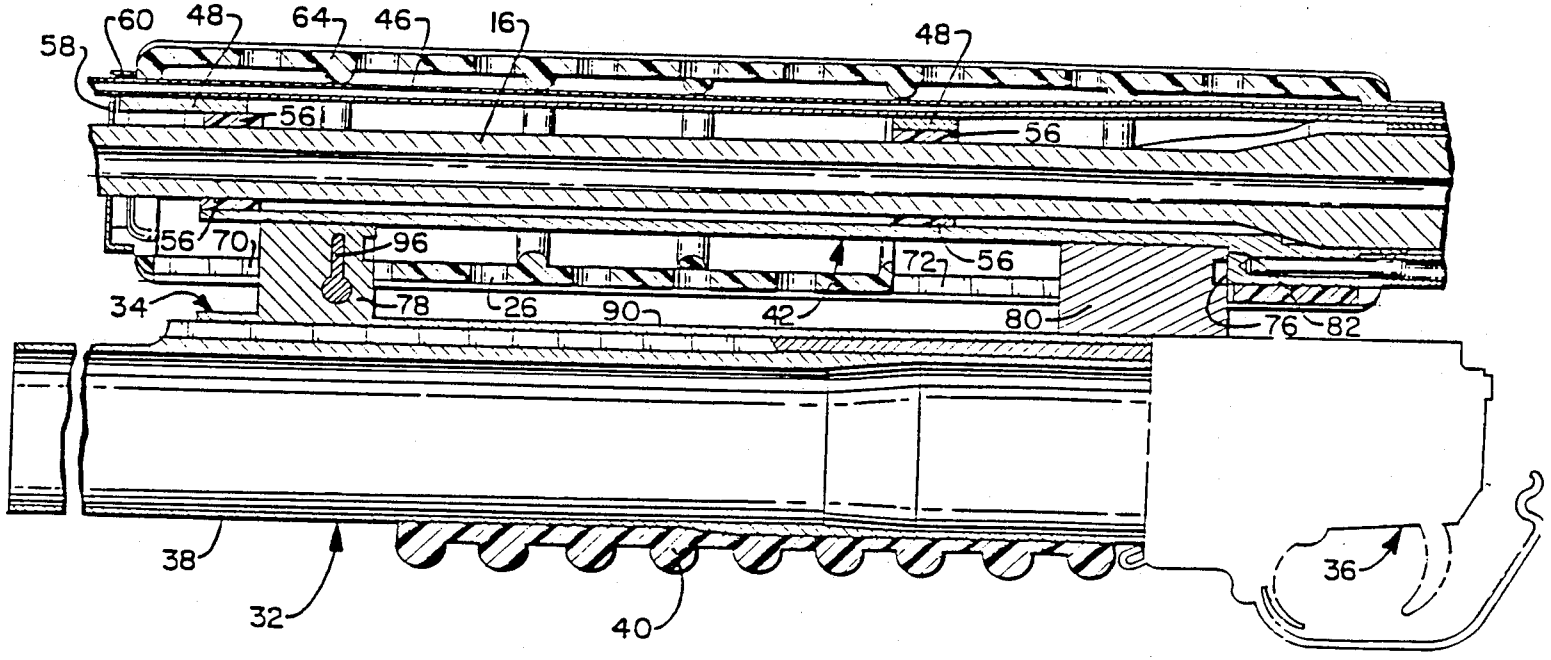
FIG. 3 is a side sectional view illustrating a grenade launcher mated to an automatic rifle by use of the present apparatus and method inventions.

FIGS. 2 and 3 illustrate in detail upper and lower racks 42,34 used to configure the rifle 10 for quick attachment of a grenade launcher 32 to, and release from, the rifle 10. Referring first to FIG. 2, the barrel 16 of the rifle 10 and various associated components are illustrated in phantom line. The forward sight 22 is illustrated at its location proximate an end of the barrel 16 remote from where the breech 12 would be, and an annular collar 44 is shown at an opposite end of the barrel 16. This collar 44 is used for holding the hand guard 26 in place. A gas tube 46 is shown as extending from the location of the forward sight 22 to the annular collar 44. The gas tube 46 communicates with the barrel 16 at a location proximate the forward sight 22 and functions to channel gas, generated by combustion within the barrel 16 to propel the bullet therethrough, back to the breech 12 in order to effect the automatic functions of the weapon. The tube 46 passes through the collar 44 and back down into the breech 12.

An upper rack 42 is mounted to the barrel 16 by appropriately structured brackets 48. Forward and rearward upper brackets 48 having screw holes 50 formed therein mate with corresponding portions 52 of the upper rack 42 and are secured together by appropriate screws 54. The brackets 48 and their corresponding portions 52 of the upper rack 42 encircle the barrel 16 and, in combination with bifurcated insulating sleeve portions 56, function to hold the upper rack 42 securely to the barrel 16.

A hand guard 26 is secured to the barrel 16 by means of the annular collar 44 proximate the breech 12 and a front plate 58 having a lip 60 to enclose a front-most portion 62 of the guard 26 therein. While only a bottom portion of the hand guard 26 is shown, it will be understood that with many weapons presently available, the hand guard 26 will also comprise an upper portion to cover the barrel 16.

The lower portion of the hand guard 26 includes a wall 64 sufficiently spaced from the barrel 16 so that the upper rack 42 and fittings 66, 68 depending therefrom are completely enclosed within the wall 64. At the bottom of the guard 26, however, slits or access parts 70, 72 are provided in order to afford access to the mating fittings 66, 68 depending from the upper rack 42.

The figures illustrate an upper rack 42 having forward and rearward mating fittings 66, 68 depending therefrom. The forward fitting 66 includes a notch 74 in one side thereof for a purpose which will be described hereinafter. The upper rack 42 is shown as having an abutment 76 immediately behind the rearward fitting 68. As will be seen subsequently within this document, a rearward mating fitting 80 of the lower rack 34, when mated with the rearward fitting 68 of the upper rack 42, positions a shoulder 82 thereof in engagement with the abutment 76 so that, when the grenade launcher 32 is fired, the bulk of the force generated by the firing will be absorbed by the abutment 76.

The lower rack 34 mounts a grenade launcher barrel 38 thereon. Mounting can be effected by providing a rail 84 on the barrel 38 which rides in a track 86 on the underside of the rack 34. The barrel 38 is attached to the rack 34 by sliding it axially relative to the rack 34 with the rail means 84 carried by the barrel 38 of the grenade launcher 32 being received within the track 86 formed in the underside of the rack 34. The barrel 38 can be locked against axial movement relative to the rack 34 by appropriate locking means such as a pivotably mounted lever 88 which carries a detent (not shown) receivable in an aperture (also not shown) formed in the barrel rail means 84.

An upwardly facing surface 90 of the lower rack 34 has, mounted thereon, a pair of mating fittings 78, 80, each having a T-shaped cross section taken along a plane generally transverse to an axis of elongation of the rack 34. The size of these fittings 78, 80 is such that they can pass through the slits or access ports 70, 72 formed in the hand guard 26. They are spaced from one another a distance the same as are spaced the fittings 66, 68 carried by the upper rack 42 so that, when the access ports 70, 72 are spaced at a similar distance, the fittings 78, 80 carried by the lower rack 34 can be inserted through the ports 70, 72 and into engagement with the fittings 66, 68 carried by the upper rack 42.

Figure 4:
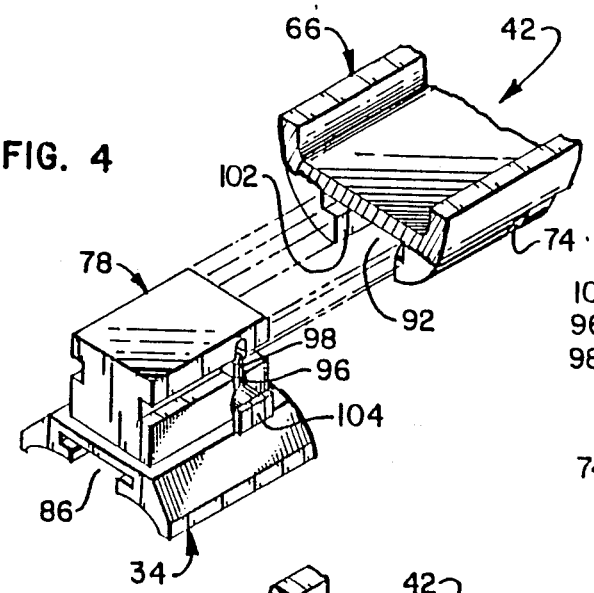
FIG. 4 is an enlarged, perspective, exploded view illustrating the manner in which a fitting carried by the lower rack is mated to, and locked against relative axial movement with, a fitting carried by the upper rack.
Figure 6:
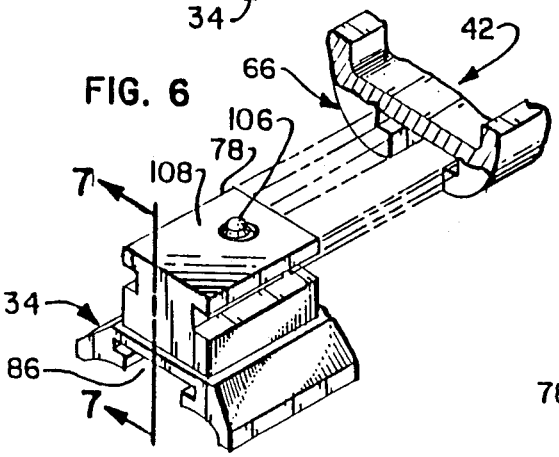
FIG. 6 is a view, similar to FIG. 4, illustrating another locking mechanism.

As best seen in FIGS. 4 and 6, the fittings 66, 68 carried by the upper rack 42 have T-shaped channels 92, 94 formed therein in order to receive the T-shaped fittings 78, 80 carried by the lower rack 34. The upper and lower rack fittings 66, 68, 78, 80 can be axially aligned and then slid relative to one another in order to effect mating.

It will be understood that the access ports 70, 72 provided in the hand guard 26 will be of a length in order to accommodate such mating. As can be seen, the ports 70, 72 will have to be at least twice the length of the fittings 78, 80 carried by the lower rack 34. The dimension of the ports 70, 72 will have to accommodate not only the lengths of the lower rack fittings 78, 80 as they are inserted therethrough, but need also accommodate the fittings 78, 80 as they are slid axially into the upper rack fittings 66, 68.

FIG. 3 illustrates a configuration wherein a grenade launching device 32 is mated to an automatic rifle 10. As seen in that figure, a shoulder 82 which forms a portion of the rearward fitting 80 carried by the lower rack 34 is in engagement with the abutment 76 formed at the back end of the upper rack 42. It is because of this positioning that the bulk of the force generated by the firing of the grenade launcher 32 will not be applied to the linkages between the fittings 66, 68, 78, 80.

Figure 5:
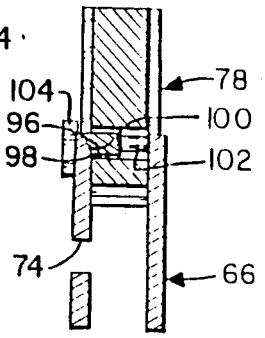
FIG. 5 is a bottom sectional view as taken through grooves on the sides of a fitting carried by the lower rack.

FIGS. 4 and 5 illustrate a preferred embodiment for locking the lower rack 34 against axial movement relative to the upper rack 42. As previously indicated, the forward fitting 66 of the upper rack 42 has, formed therein, a notch 74 on one side thereof. The forward fitting 78 carried by the lower rack 34 includes a detent 96 which is mounted for reciprocation in a direction generally transverse to the direction along which the fittings 66, 78 are mated. The detent 96 is normally biased outwardly so that, when the fittings 66, 78 are in a mated relationship, it will snap into the notch 74 in the upper rack fitting 66.

The detent 96 can be beveled along an edge 98 first entering the channel 92 into which the lower rack fitting 78 is inserted in order to facilitate overcoming of the bias of the detent 96 to allow mating. Similarly, an edge 100 of the track 102 first engaged by the detent 96 can also be beveled in order to further facilitate mating. These bevels can ride up one another in order to urge the detent 96 inwardly. Once the detent 96 becomes registered with the notch 74, it will automatically snap outwardly to be received in the notch 74.

Means are provided for overcoming the bias of the detent 96 urging into the notch 74 when it is desirable to remove the grenade launcher 32 from the rifle 10. A button 104, rigidly secured to the detent 96 and accessible when the fittings 66, 78 are mated, is carried by the lower rack fitting 78 for this purpose. When the operator of the weapon desires to remove the launcher 32 from the rifle 10, this button 104 can be moved inwardly, and the detent 96 will also move inwardly. At its innermost position, the detent 96 will not obstruct axial movement of the lower rack 34 relative to the upper rack 42, and the fittings 66, 78 can be unmated by moving the lower rack 34 axially relative to the upper rack 42 in a direction opposite that in which it is moved in mating the two together.

Figure 7:
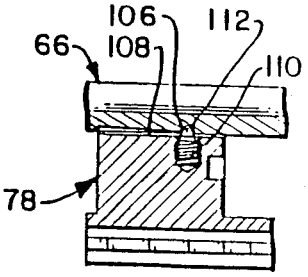
FIG. 7 is a side sectional view taken generally along the line 7—7 of FIG. 6.

FIGS. 6 and 7 illustrate an alternative embodiment for locking the racks 34, 42 against relative axial movement The lower rack fitting 78 can carry a detent 106 in an upper surface 108 thereof. The detent 106 would be biased upwardly by any appropriate means such as a spring 110. An aperture 112 can be formed at a corresponding location in a downwardly facing surface of the upper rack fitting 66 to which the lower fitting 78 is to be mated. The outer surface of the detent 106 can be beveled or rounded in order to facilitate mating and unmating. Mating and unmating can be accomplished by imparting a quick, jerking motion to the grenade launcher device 32 relative to the rifle 10. If desired, the downwardly facing surface of the upper rack fitting 66 can be sloped in order to facilitate the overcoming of the detent bias.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for configuring and deconfiguring an automatic rifle with a grenade launching device to be mounted to the barrel of the rifle, comprising:

(a) a unitary upper rack including a base portion and at least two quick connect/disconnect fittings depending from said base portion and being spaced from each other at fixed, defined distances along said base portion;

(b) means for securing said upper rack to the barrel of the rifle at a desired location therealong;

(c) a lower rack having means for suspending the grenade launching device therefrom;

(d) quick connect/disconnect fittings carried by said lower rack for selectively mating and unmating said upper and lower racks with respect to one another, said fittings carried by said lower rack being fixedly spaced from each other at a distance the same as that at which said fittings carried by said upper rack are spaced; and (e) a hand guard attachable to the rifle to enclose said upper rack and a portion of the barrel of the rifle to which said upper rack is secured, said guard having apertures formed therein to permit said quick connect/disconnect fittings carried by said lower rack to pass through said apertures to mate precisely with said quick connect/disconnect fittings carried by said upper rack.

2. Apparatus in accordance with claim 1 wherein said guard has two apertures, spaced from one another axially along an axis of elongation of the rifle barrel, formed therein, and wherein said upper and lower rack quick connect/disconnect fittings comprise:

(a) forward and rearward upper rack fittings spaced at axial locations so that each can be disposed proximate a different one of said apertures formed in said guard; and (b) forward and rearward lower rack fittings spaced at axial locations at a distance from one another the same as the distance at which said fittings carried by said upper rack are spaced.

3. Apparatus in accordance with claim 2 wherein said lower rack quick connect/disconnect fittings comprise forward and rearward T-shaped fittings, said fittings having laterally extending arms, and wherein said upper rack quick connect/disconnect fittings comprise forward and rearward fittings, each of said upper rack fittings having formed therein a T-shaped channel sized and shaped to slidably receive a corresponding of said lower rack fittings.

4. Apparatus in accordance with claim 3 further comprising means for locking said upper and lower racks against relative axial movement when said racks are in mated configuration.

5. Apparatus in accordance with claim 4 wherein said locking means comprises a lower rack fitting including a reciprocably mounted detent disposed on a surface of said fitting receivable within the T-shaped channel formed in the corresponding upper rack fitting, and a corresponding upper rack fitting having an aperture formed therein to receive said detent when said upper and lower racks are properly mated.

6. Apparatus in accordance with claim 5 further including means biasing said detent toward a position wherein it can be received within said aperture.

7. Apparatus in accordance with claim 2 wherein said upper rack includes an abutment axially rearwardly from said rearward fitting carried thereby, and wherein said rearward fitting carried by said lower rack includes a shoulder engaging said abutment when said lower rack is mated to said upper rack, wherein said abutment receives the force of recoil resulting from the firing of the grenade launching device to relieve stress that would otherwise be imposed upon said fittings.

* * * * *